US010240891B2

(12) United States Patent
Miller et al.

(10) Patent No.: US 10,240,891 B2
(45) Date of Patent: Mar. 26, 2019

(54) REINFORCEMENT MEMBER FOR A FIREARM STOCK AND RELATED METHODS

(71) Applicant: Magpul Industries Corp., Austin, TX (US)

(72) Inventors: Christopher F. Miller, Erie, CO (US); Eric Chow, Highlands Ranch, CO (US); Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/610,126

(22) Filed: May 31, 2017

(65) Prior Publication Data

US 2018/0003459 A1 Jan. 4, 2018

Related U.S. Application Data

(60) Provisional application No. 62/357,236, filed on Jun. 30, 2016.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/20; F41C 23/04; F41C 23/06; F41C 23/08; F41C 23/14
See application file for complete search history.

(56) References Cited

U.S. PATENT DOCUMENTS

| | | | |
|---|---|---|---|
| 6,070,354 | A | 6/2000 | Burigana et al. |
| 6,401,379 | B1 | 6/2002 | Moon |
| 8,062,736 | B1 | 11/2011 | Coolong et al. |
| 8,191,299 | B2 | 6/2012 | Faifer |

(Continued)

FOREIGN PATENT DOCUMENTS

| | | | |
|---|---|---|---|
| CA | 2206237 | * | 11/1998 |
| EP | 1357348 | A1 | 10/2003 |
| EP | 1357348 | B1 | 3/2006 |

OTHER PUBLICATIONS

Bravo Company USA, "BCMGUNFIGHTER Stock Assembly—Black", Known to exist as early as Dec. 15, 2015, p. 6, Retrieved from http://www.bravocompanyusa.com/BCM-GUNFIGHTER-s-Stock-Mod-0-Black-p/bcm-gfs-mod-0-blk.htm, Published in: US.

(Continued)

*Primary Examiner* — Stephen Johnson
(74) *Attorney, Agent, or Firm* — Neugeboren O'Dowd PC

(57) ABSTRACT

A firearm stock with a reinforcing member and related methods are disclosed. A reinforcing member has a proximal end having at least one proximal tab shaped to engage a firearm housing, and a distal end having a locking pin engagement surface and at least one distal tab shaped to engage at least one of the firearm housing or a battery tube. The member also has a longitudinal axis extending between the proximal end and the distal end, and a first wall having a longitudinal length greater than a width. The member also has at least one sidewall one of coupled to or unitary with the first wall, and at least one side tab positioned on the sidewall and extending towards a center portion of the reinforcing member.

9 Claims, 23 Drawing Sheets

(56) References Cited

U.S. PATENT DOCUMENTS

| | | | | |
|---|---|---|---|---|
| 8,555,541 | B2 | 10/2013 | Ingram | |
| 8,713,837 | B2 | 5/2014 | Simpson | |
| 8,756,849 | B2 | 6/2014 | Troy | |
| D722,357 | S | 2/2015 | Keller et al. | |
| D722,669 | S | 2/2015 | Keller | |
| 8,978,284 | B1 | 3/2015 | Zusman | |
| 8,978,285 | B1 | 3/2015 | Burke et al. | |
| 9,062,923 | B1 * | 6/2015 | Thorup | F41A 3/64 |
| D738,981 | S | 9/2015 | Zusman | |
| 9,140,519 | B2 | 9/2015 | Simpson | |
| 9,217,620 | B2 | 12/2015 | Peacemaker | |
| 9,310,159 | B1 | 4/2016 | Lemoine | |
| D796,617 | S | 9/2017 | Chow et al. | |
| 2005/0039368 | A1 | 2/2005 | Crawford | |
| 2007/0033850 | A1 | 2/2007 | Murello et al. | |
| 2012/0144715 | A1 | 6/2012 | Simpson | |
| 2012/0186124 | A1 | 7/2012 | Kincel | |
| 2012/0266514 | A1 | 10/2012 | Michal et al. | |
| 2014/0075815 | A1 | 3/2014 | Jarboe | |
| 2016/0084612 | A1 * | 3/2016 | Robinson | F41C 23/14 42/73 |
| 2016/0327362 | A1 * | 11/2016 | Eitan | F41C 23/02 |

OTHER PUBLICATIONS

Damage Industries, "Stock, Enhanced Combat System", Known to exist as early as Dec. 15, 2015, p. 5 Retrieved from http://damageindustries.co/index.php?route=product/product&product_id=141&search=ecssTOCKS.

Lewis Machine & Tool Company, Inc., "SOPMOD Buttstock", Known to exist as early as Dec. 15, 2015, p. 1, Retrieved from http://www.lmtstore.com/parts/buttstocks/sopmod-buttstock.html.

Magpul Industries, Corp., "MOE SL Carbine Stock MIL-SPEC", etrieved from https://www.magpul.com/products/moe-sl-carbine-stock-mil-spec, Oct. 14, 2015, p. 4.

Rogers Shooting School, Inc., "Rogers Super-Stoc", Known to exist as early as Dec. 15, 2015, p. 6 Retrieved from http://www.rogersshootingschool.com/products/superstoc.php.

VLTOR Weapon Systems, "IMOD: Improved Modular Stock", Known to exist as early as Dec. 15, 2015, p. 3, Retrieved from https://www.vltor.com/shop/stocks/imod-improved-modular-stock/.

* cited by examiner

REINFORCEMENT MEMBER FOR A FIREARM STOCK AND RELATED METHODS

CROSS-REFERENCE TO RELATED APPLICATIONS

This application claims priority to U.S. Provisional Application No. 62/357,236 filed on Jun. 30, 2016, and entitled "REINFORCEMENT MEMBER FOR A FIREARM STOCK AND RELATED METHODS," the entire disclosure of which is hereby incorporated by reference for all proper purposes.

FIELD

The present disclosure relates to firearms. In particular, but not by way of limitation, the present disclosure relates to systems and methods for a firearm stock having an improved drop strength.

BACKGROUND

A user of a firearm such as a rifle or carbine may sometimes inadvertently drop or intentionally force the firearm to the ground (such as to clear a jammed firearm mechanism), and, for this reason, drop strength is an important factor in the development of firearms. With advances in polymeric materials being used in, for example, carbine stocks, manufacturers have the ability to provide users with relatively lightweight firearms, even in those having adjustable stocks.

Adjustable stocks generally have a housing and a lever that can be disengaged or pivoted, so as to allow a locking pin to engage the carbine buffer tube (or receiver extension) at various points along the tube. That is, the locking pin may move into and out of a number of holes in the extension tube so as to enable adjustment of the length of pull. In doing so, the locking pin may also travel through or within a hole placed in the housing of the stock.

However, when the stock/firearm is dropped, the impact may cause the polymeric housing to break completely, or deform (such as at the hole through which the locking pin passes) in a manner that prevents the stock from being adjusted again. For example, the impact may cause the locking pin to deform the hole such that the hole in the housing can no longer accept the pin, and/or the deformed hole may allow the locking pin to shift, becoming stuck, or otherwise unable to properly travel in a direction transverse to the holes in the buffer tube.

In some cases, when the stock/firearm is dropped, the locking pin, which may be steel, may exert enough load to the buffer tube, which may be aluminum, to cause the hole in the buffer tube to deform. If the locking pin itself also bends or shifts, the damage may be exaggerated, and thereby allow the locking pin to dive and disengage (also known as auto-collapse).

In some cases, when the stock/firearm is dropped, the locking pin itself may bend under load and causes jams. This may happen either as the lone failure mechanism, or in conjunction with deformation of the housing and/or the hole in the buffer tube, as described above.

All three of the failure modes described above may occur independently or in conjunction.

Therefore, there remains a need for a lightweight firearm stock with an improved drop strength, and/or other new and innovative features.

SUMMARY

An exemplary reinforcing member for a firearm stock has a proximal end having at least one proximal tab shaped to engage a firearm housing, and a distal end having a locking pin engagement surface and at least one distal tab shaped to engage at least one of the firearm housing or a battery tube. The exemplary member also has a longitudinal axis extending between the proximal end and the distal end, and a first wall having a longitudinal length greater than a width. The exemplary member also has at least one sidewall one of coupled to or unitary with the first wall, and at least one side tab positioned on the sidewall and extending towards a center portion of the reinforcing member.

An exemplary firearm stock has a housing having a first hardness, a ridge substantially positioned in a central portion of the housing and extending in a longitudinal direction, and a proximal wall. The exemplary stock also has a movable locking pin at least partially positioned in a distal portion of the housing. The exemplary stock also has a reinforcing member positioned on the ridge and extending longitudinally less than an entire length of the stock, the reinforcing member shaped and positioned to transfer forces between the locking pin and the proximal wall.

An exemplary method of making a reinforcing member for a firearm stock includes providing a section of sheet metal and shaping a first wall from the sheet metal, the first wall having a longitudinal length greater than a width, and a distal end having a locking pin engagement surface. The exemplary method also includes shaping at least one sidewall from the sheet metal, and shaping at least one side tab on the sidewall. The shaping the first wall and the shaping the at least on sidewall may include bending the section of sheet metal to form the first wall and the at least one sidewall whereby the first wall and the at least one sidewall are unitary.

DETAILED DESCRIPTION

Figure 1:
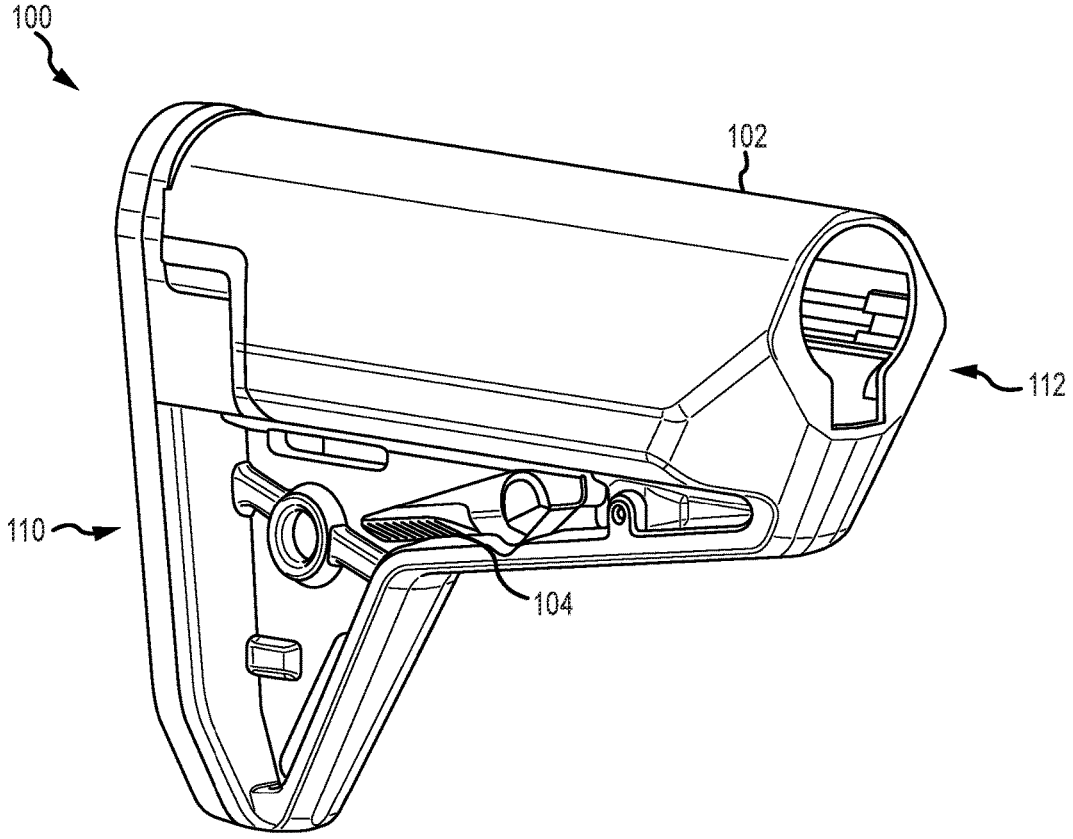
FIG. 1 illustrates a perspective view of a carbine stock suitable for use with a reinforcing member described herein.
Figure 2:
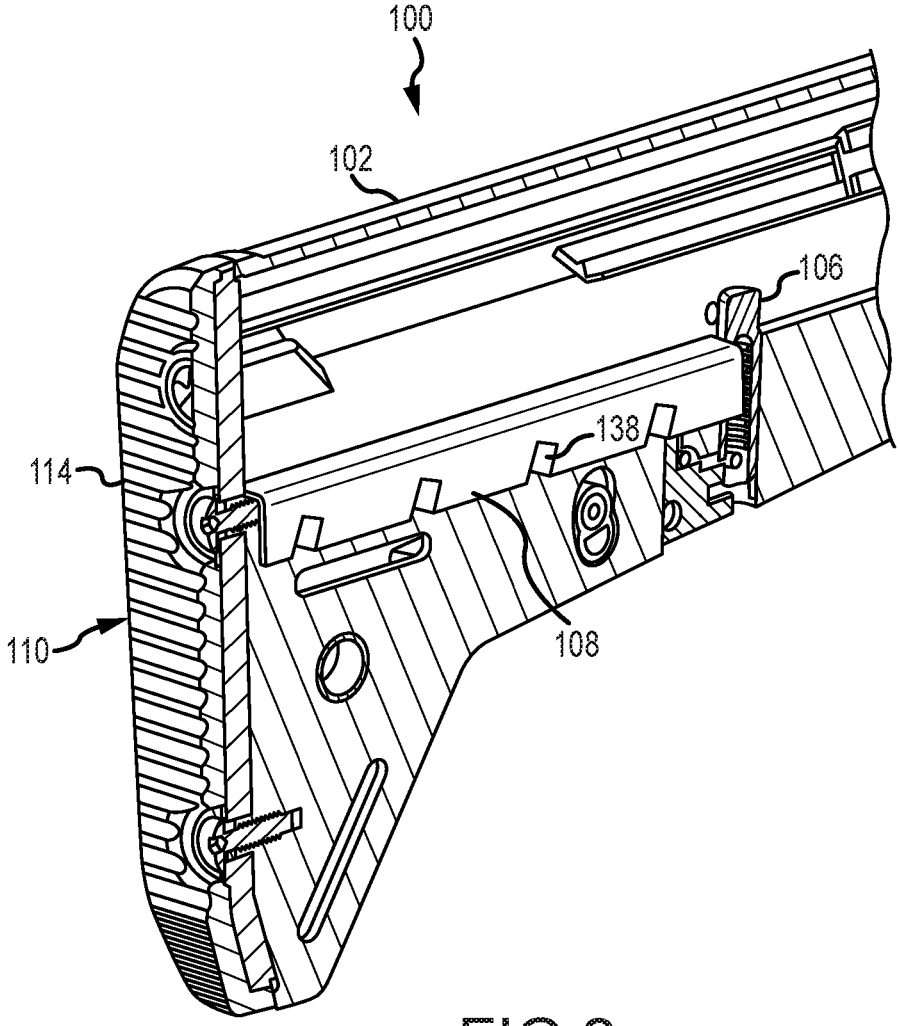
FIG. 2 illustrates portions of the interior of the stock in FIG. 1, with a reinforcing member.

Before describing various embodiments and examples in detail, a general overview is provided herewith, so as to enable the reader to better understand the details that follow. Currently-available stocks for firearms are often manufactured of a lightweight polymeric material, so as to reduce the weight of the stock. Although the reduced weight is generally considered a significant advantage, Applicants have developed and describe herein an adjustable carbine stock having the advantage of reduced weight, but with an improved drop strength, and, in turn, improved reliability in the length of pull mechanism. The improved drop strength may be provided by a reinforcement member, at least a portion of which may be positioned within a housing of the stock.

Referring now to the drawings, where like or similar elements are designated with identical reference numerals throughout the several views, and referring in particular to FIGS. 1-4, shown is a stock 100 for a firearm, such as a carbine stock having a storage capability and a length of pull adjustment feature. The stock 100 has a proximal end 110, a distal end 112, a housing 102, a length of pull adjustment lever 104, and a locking pin 106 (see FIG. 2). The locking pin 106 is movable in response to operation of the lever 104 to engage one of a number of holes in a buffer tube (not illustrated) of a firearm, thereby providing a length of pull adjustment function.

The stock 100 also has a reinforcing member 108, at least a portion of which is positioned between the locking pin 106 and the proximal end 110 of the housing 102, or between the locking pin 106 and the buttpad 114 of the stock 100. The reinforcing member 108 may be made of a relatively hard material, such as a metal, including a carbon or stainless steel, etc. In some embodiments, the housing 102 is made of a material having a first hardness, and the reinforcing member 108 is made of a material having a second hardness greater than the first hardness. In some embodiments, the reinforcing member 108 is made of a material that is less elastic than the material making up the housing 102. In some embodiments, the reinforcing member 108 is made of a material that is less prone to deformation than the housing 102 material. In some embodiments, the locking pin 106 and the reinforcing member 108 are metallic, and the housing 102 comprises a polymer.

As previously described in the Background of this document, three modes of failure may generally occur when a user drops for forces a stock/firearm to the ground: the (usually polymeric) housing may deform or break, the buffer tube may deform, and/or the locking pin may deform or break. The reinforcing member 108 described herein directly reduces the likelihood of the housing 102 deforming or breaking, particularly at an interface between a surface defining a hole 107 in the housing 102 and the locking pin 106 (see e.g. FIG. 3) by adding strength and rigidity to the weaker polymeric sections.

The reinforcing member 108 may also reduce the likelihood of the buffer tube (not illustrated) and locking pin 106 deforming in an indirect manner.

Figure 3:
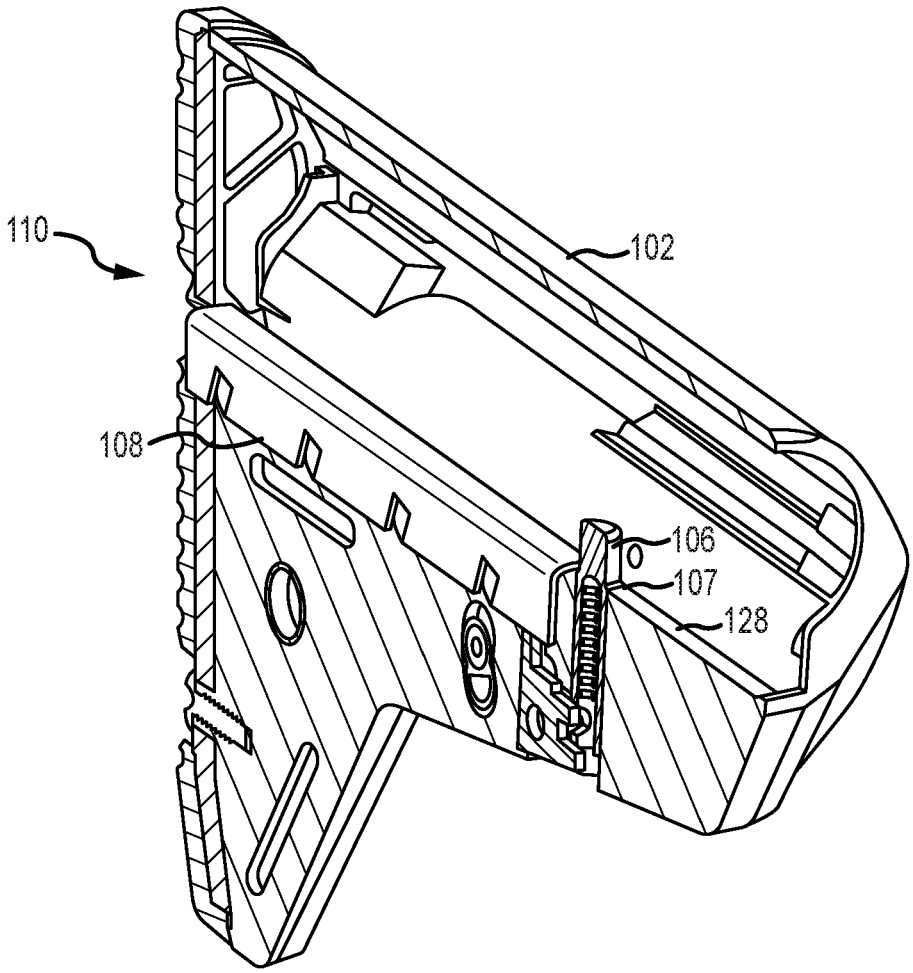
FIG. 3 illustrates portions of the interior of the stock in FIG. 1, with a reinforcing member.
Figure 3A:
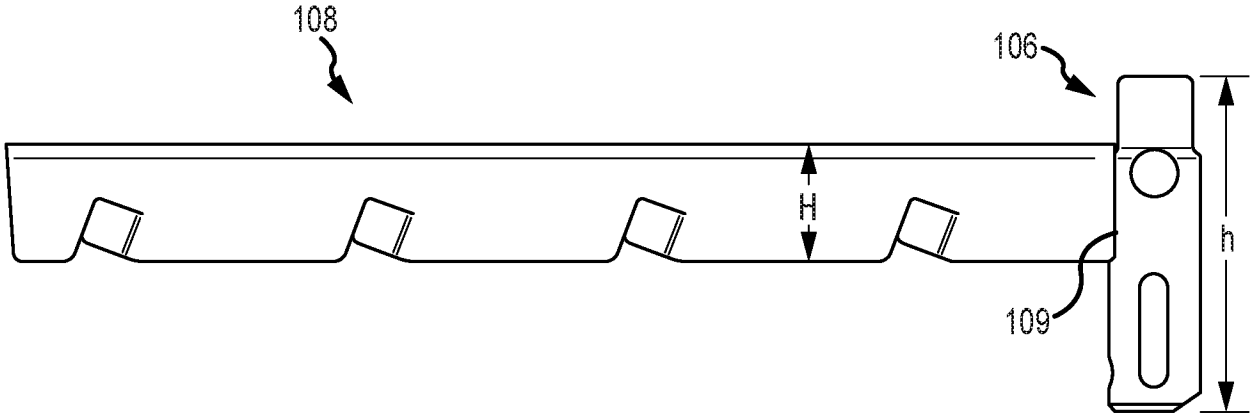
FIG. 3A is a side view of a reinforcing member and locking member suitable for use in the stock in FIG. 1.
Figure 4:
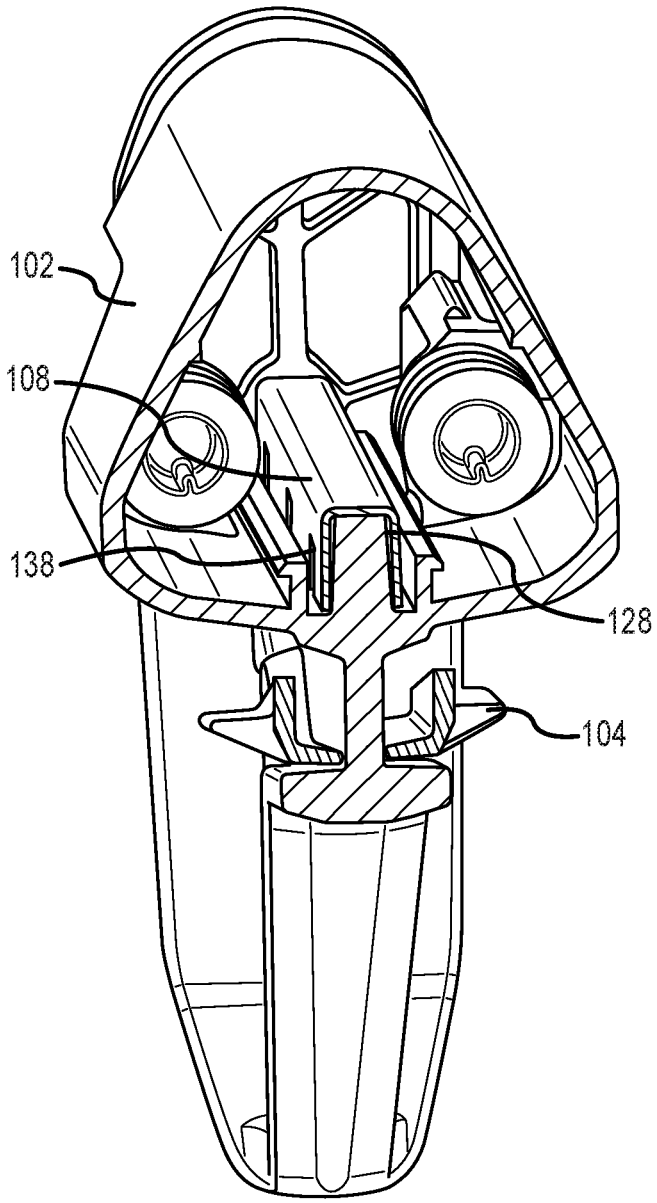
FIG. 4 is a section view of the stock and reinforcing member in FIG. 1.

Specifically, because the hole 107 does not deform as much (either plastically or elastically), or at all, due to the extra rigidity provided by the reinforcing member 108, the locking pin 106 has more support from the housing 102, and will tend to bend less due to a reduced moment arm. Moreover, and as illustrated most clearly in FIGS. 3A and 4, the reinforcing member 108 may be shaped in some embodiments with an engagement surface 109 that engages a substantial portion of the locking pin 106. In some embodiments, the engagement surface 109 of the reinforcing member 108 may have a height H that is at least 25% of the height h of the locking pin 106 (see FIG. 3A). In some embodiments, the engagement surface 109 of the reinforcing member 108 may have a height H that is at least one-third of the height h of the locking pin 106. In some embodiments, the engagement surface 109 of the reinforcing member 108 may have a height H that is at least one-half of the height h of the locking pin 106. In some embodiments, the engagement surface 109 of the reinforcing member 108 may have a height H that is between 25% and 50% of the height h of the locking pin 106. In some embodiments, the engagement surface 109 of the reinforcing member 108 may have a height H that is at least 75% of the height h of the locking pin 106.

Continuing now with FIGS. 1-5, the reinforcing member 108 may reduce the likelihood of the buffer tube (not illustrated) deforming indirectly. Specifically, by ensuring that the hole 107 in the housing 102 is more rigidly positioned, the locking pin 106 is maintained in a position or suitably aligned so as to correctly engage the mating buffer tube hole (not illustrated). By comparison, if the locking pin 106 is allowed to move out of alignment, the buffer tube hole may be punched or deformed into an egged-out hole with an angle that would allow that locking pin 106 to back-drive.

Continuing now with reference to FIGS. 5-9, the reinforcing member 108 may have a first wall 120, a second wall 122, and a third wall 124, positioned relative to each other to form a channel 126 therebetween. The channel 126 may be shaped so as to fit on or about a ridge 128 (see e.g. FIG. 4), flange, or brace formed in the housing 102, and may extend between a proximal end 130 and a distal end 132 of the reinforcing member 108. In some embodiments, the reinforcing member 108 is made by forming a sheet metal into an elongated member having at least two walls forming a channel therebetween.

In some embodiments, the reinforcing member 108 may be a retrofit or aftermarket device for improving the drop strength of currently-available carbine stocks. In some embodiments, the reinforcing member 108 is shaped and selected so as to not weigh more than 30 grams (or about 1 ounce). In some embodiments, the reinforcing member 108 comprises titanium, steel, aluminum, an alloy, and/or a material that is stronger than the material surrounding or defining the hole 107 of the housing 102.

Figure 5:
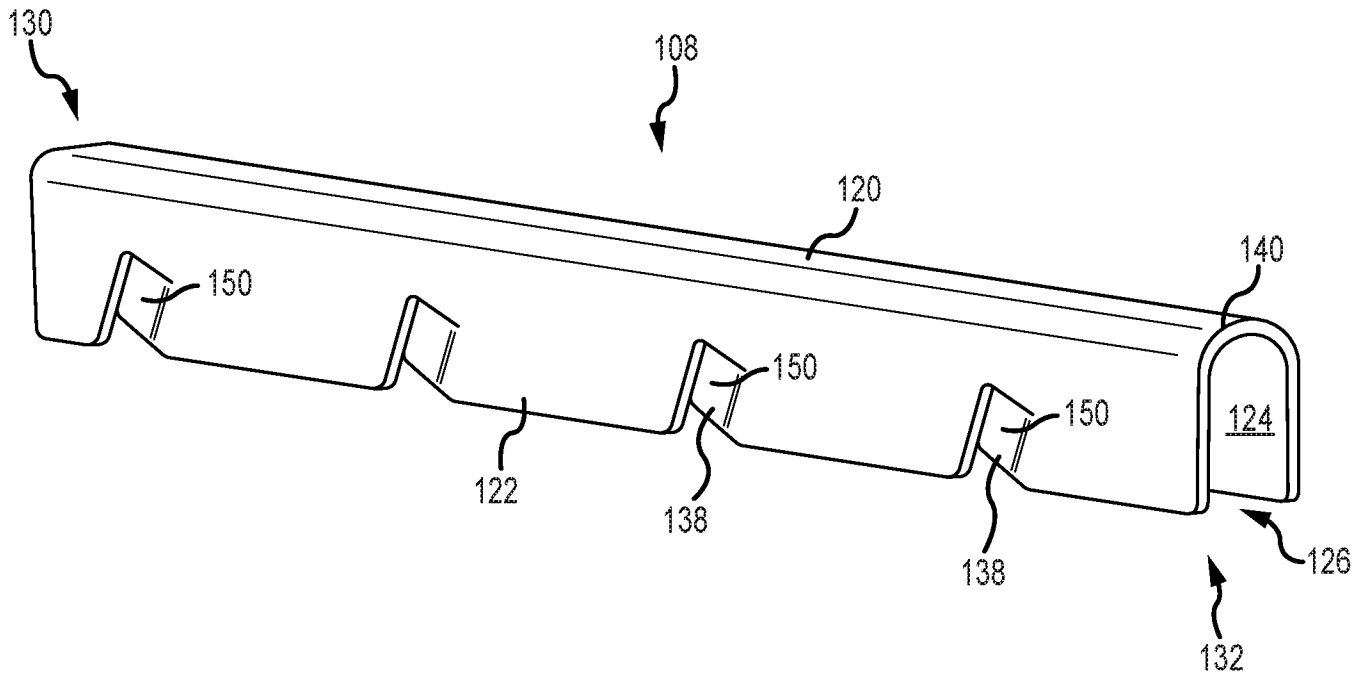
FIG. 5 is a perspective view of a reinforcing member suitable for use in the stock in FIG. 1.

As illustrated in FIG. 5, in some embodiments, a distal surface of the reinforcing member 108 may have a pin engagement surface 140 that is shaped to engage the locking pin 106; for example, the pin engagement surface 140 may be a curved portion of the distal end 132 of the reinforcing member 108. In some embodiments, a proximal surface of the reinforcing member 108 may have a surface portion 142 (see e.g. FIG. 7) configured to engage a proximal wall or the buttpad 114. The proximal surface portion 142 may be flat, although those skilled in the art will recognize that this is not necessarily a requirement.

With continued reference to FIG. 5, one or both of the second and third walls 122, 124 may have one or more tabs 138 protruding into or away from the channel 126. In some embodiments, the tab(s) 138 may protrude into the channel 126 in a manner that dissipates impact forces from the locking pin 106 into other regions of the housing 102 or buttpad 114. That is, when the stock 100 is dropped, the tabs 138 are shaped to as to dissipate the impact force between the locking pin 106 and housing 102 throughout the housing 102 and/or buttpad 114. In doing so, the reinforcing member 108 may effectively prevent the locking pin 106 from permanently deforming the housing 102 when dropped.

In some embodiments, the reinforcing member 108 may be configured to provide an impact surface area that is greater than an impact surface area provided by the locking pin 106. That is, those skilled in the art will recognize that a longitudinal impact force against the locking pin 106 might generally be considered to be spread across any components abutting the locking pin 106, such as the pin engagement surface 140, while each of the tabs 138 effectively provides an additional surface area 150 such that, when summed, the tabs 138 increase the surface area through which the impact force is spread, thereby reducing impact force concentrations in the housing 102. The angular nature of the tabs 138 may further assist in impact force dissipation.

In some embodiments, the tab(s) 138 may be shaped to extend inward toward the channel 126 so as to dissipate impact forces from the pin 106 through the reinforcing member 108 and into the ridge 128 (see FIG. 4) and/or to grip the ridge 128 to reduce the likelihood of the reinforcing member 108 shifting within the housing 102. In some embodiments, the tab(s) 138 may be shaped to grip the ridge 128 or provide an interference fit with the ridge 128. In some embodiments, the tab(s) 138 may be configured to increase a transverse gripping force on the ridge 128 or housing 102 in response to a longitudinal impact force on the stock 100.

Figure 6:
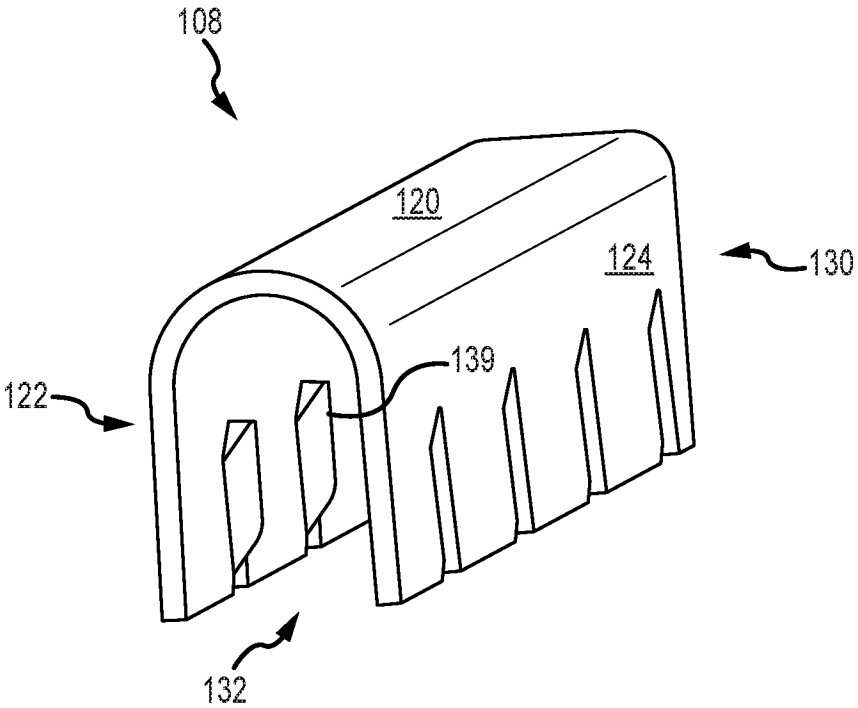
FIG. 6 is another perspective view of the reinforcing member in FIG. 5.
Figure 7:
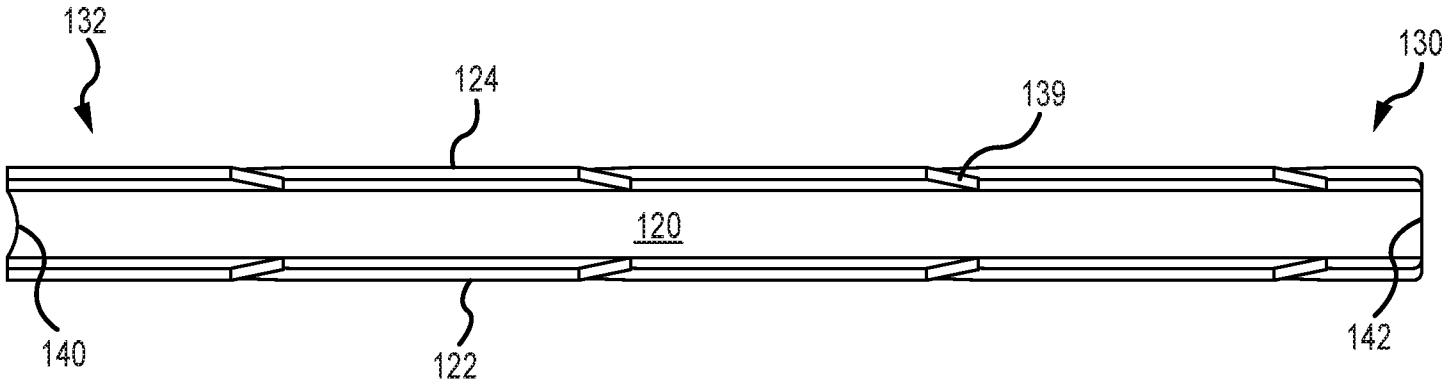
FIG. 7 is a bottom view of the reinforcing member in FIG. 5.
Figure 8:
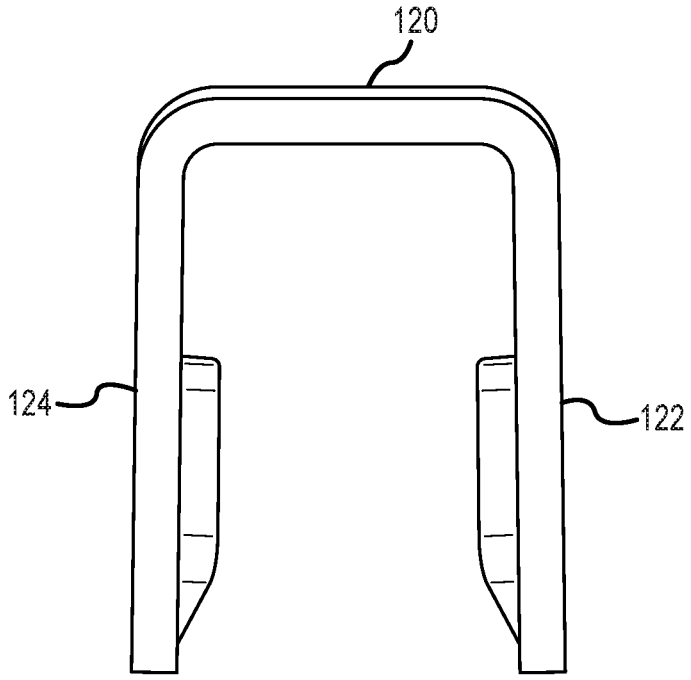
FIG. 8 is a back view of the reinforcing member in FIG. 5.
Figure 9:
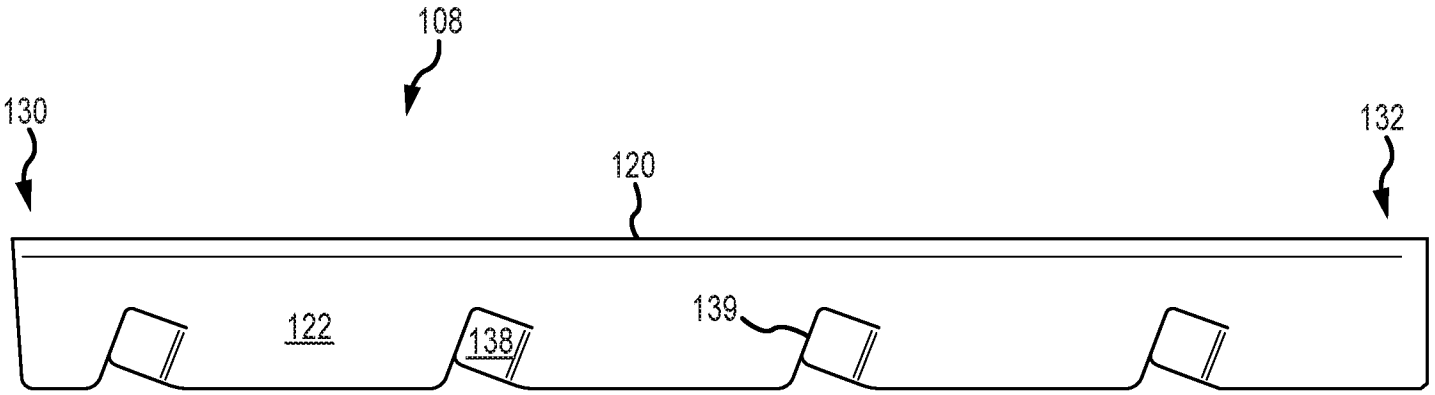
FIG. 9 is a side view of the reinforcing member in FIG. 5.

In some embodiments, and as most clearly illustrated in FIGS. 6-7, one or more of the tab(s) 138 may have engagement surface(s) 139 or end(s) that cause the reinforcing member 108 to tend to dive down into firmer engagement with the ridge when back driven.

In some embodiments, the reinforcing member 108 may be removable from the housing 102, such as by sliding off the ridge 128. In some embodiments, the reinforcing member 108 may be slidably coupled to the housing 102.

Figure 10:
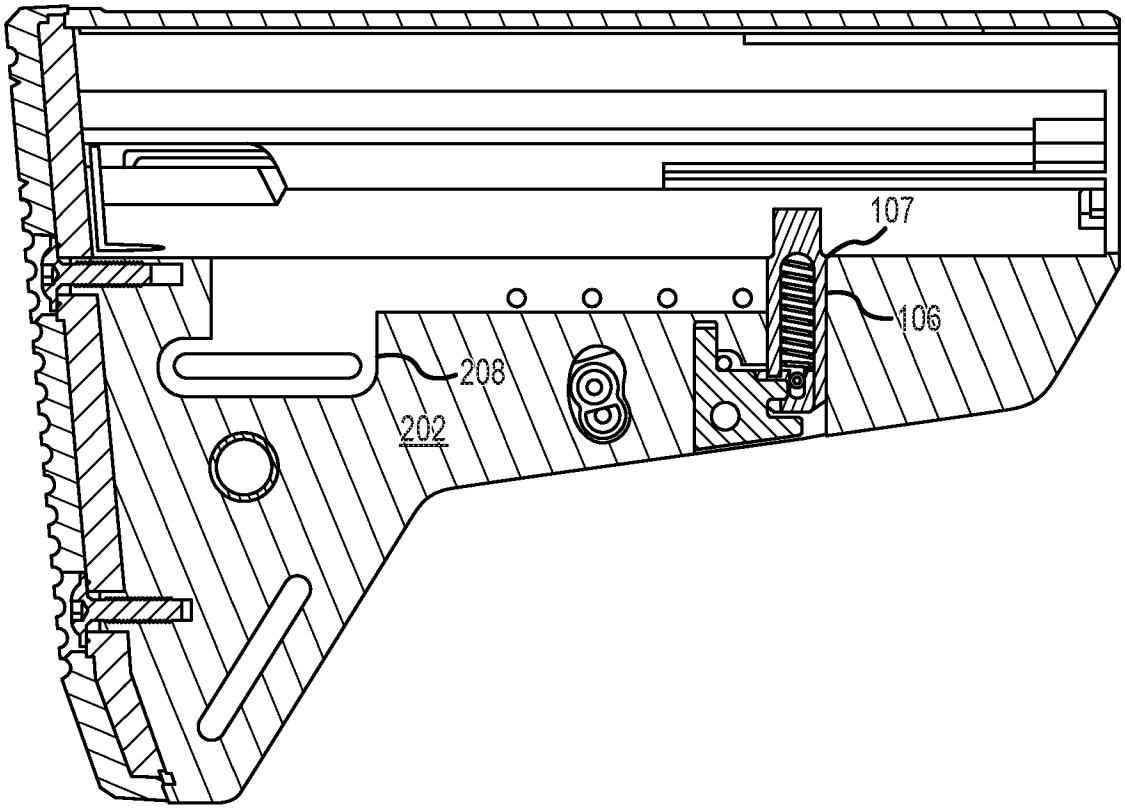
FIG. 10 is a side view of portions of a stock with a reinforcing member.

Turning now to FIG. 10, in some embodiments, the housing 202 may be overmolded on the reinforcing member 208. As previously described herein, the reinforcing member 208 may be shaped so as to provide a greater surface area of contact between the housing 202 and the reinforcing member 208 than a surface area of contact between the locking pin 106 and the reinforcing member 208. Other features of the reinforcing member 208 and housing 202 may be substantially similar or identical to the reinforcing member 108 and the housing 102 previously described herein.

Figure 11:
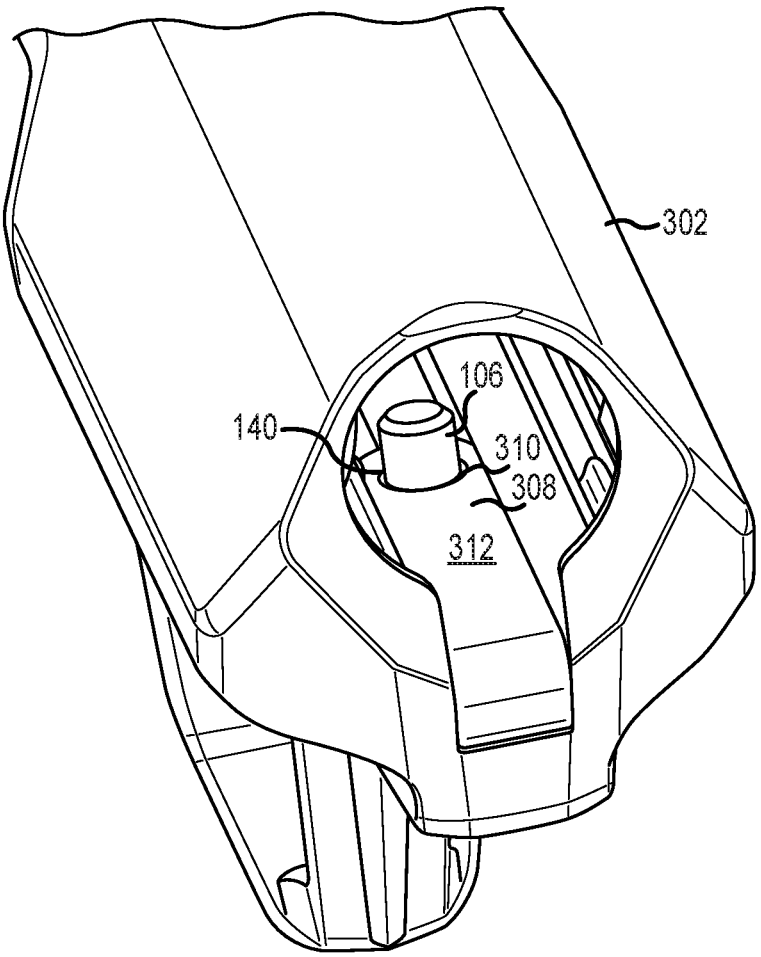
FIG. 11 is a perspective view of portions of a stock with a reinforcing member.
Figure 12:
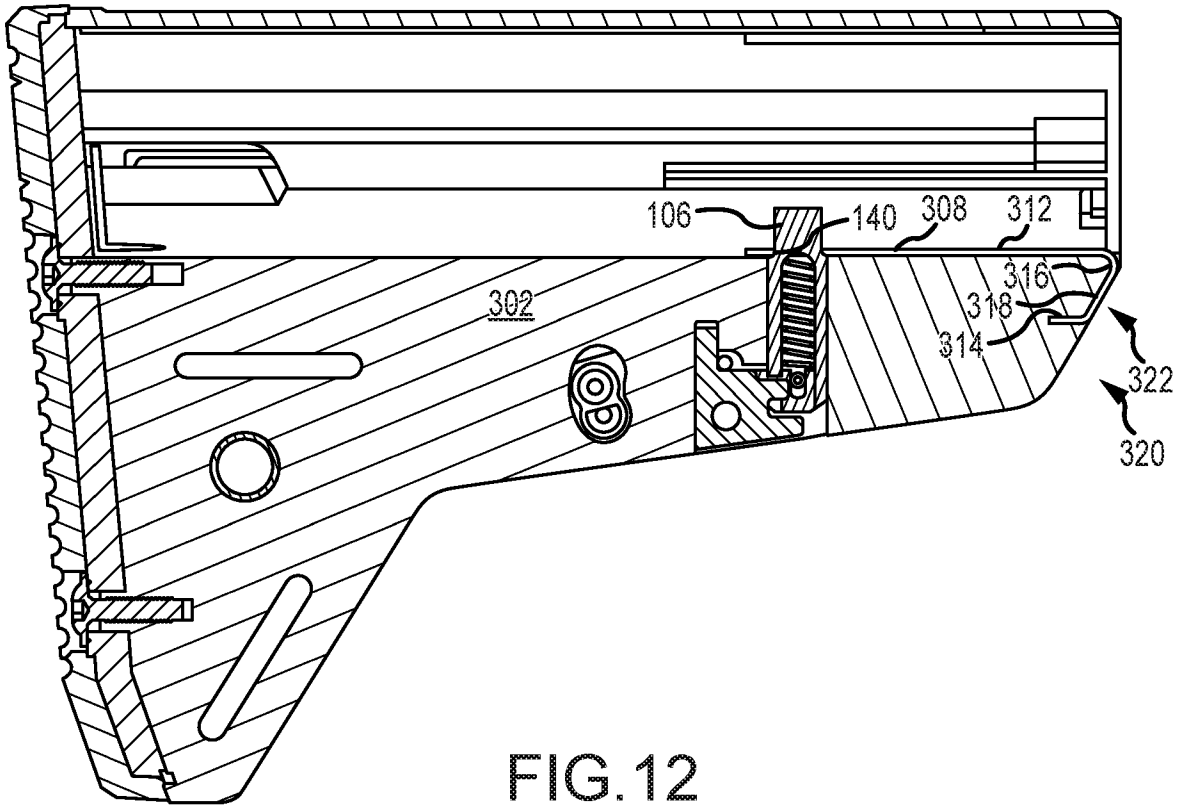
FIG. 12 is a side view of portions of the stock and member in FIG. 11.
Figure 12A:
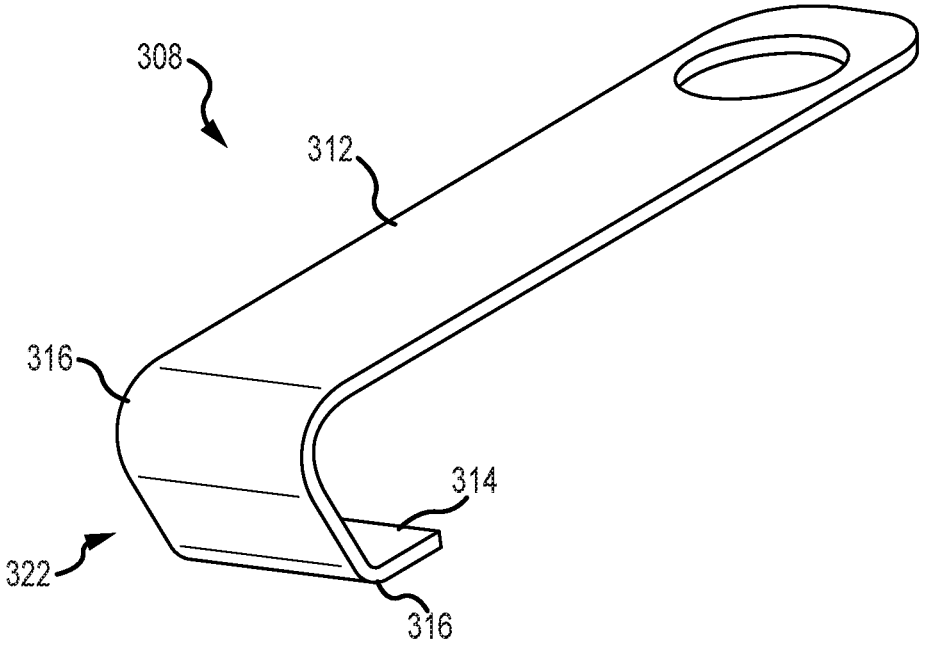
FIG. 12A is a perspective view of the reinforcing member in the stock in FIG. 11.

With reference now to FIGS. 11-12, in some embodiments, the reinforcing member 308 may be shaped and positioned to act in a manner similar to a tensioning spring between the locking pin 106 and a distal end 320 of the housing 302, in response to a longitudinal impact force. That is, in response to a longitudinal impact force, such as dropping the stock, the reinforcing member 308 may be shaped or configured to limit the locking pin 106 from moving away from the distal end 320 of the housing 302. In some embodiments, the reinforcing member 308 may be formed of a sheet metal with a hole or passage 310 through which the locking pin 106 may travel. In some embodiments, the reinforcing member 308 may have a first elongate member 312 configured to extend longitudinally within a carbine stock housing 302, and a second elongate member 314 coupled to a distal end of the first elongate member 312. The second elongate member 314 may be shaped or configured to extend within the housing 302 as well. In some embodiments, the first and second elongate members 312, 314 are parallel to each other. In some embodiments, the first and second elongate members 312, 314 are coupled together by one or more curved sections 316. In some embodiments, the reinforcing member 308 includes an elongate member 322 shaped to curve about a distal surface 318 of the housing 302. In some embodiments, the reinforcing member 308 is removably placed in the housing 302. In some embodiments, the housing 302 is overmolded on the reinforcing member 308. The reinforcing member 308 may have a pin engagement surface 140 substantially as previously described herein. Other features of the reinforcing member 308 and the housing 302 may be substantially similar or identical to the reinforcing member 108 and the housing 102 previously described herein.

Although not illustrated, those skilled in the art will recognize that, in some embodiments, the reinforcing member may be a sleeve, such as a cylindrical sleeve placed, pressed, or molded into the hole 107 of the housing 102, so as to provide a rigid engagement surface for the locking pin 106. Those skilled in the art will also recognize that the reinforcing member 108 may have a distal end that has a loop or hole (similar to the hole in reinforcing member 308) so as to further improve the mode of engagement between the reinforcing member 108 and the locking pin 106.

Figure 13:
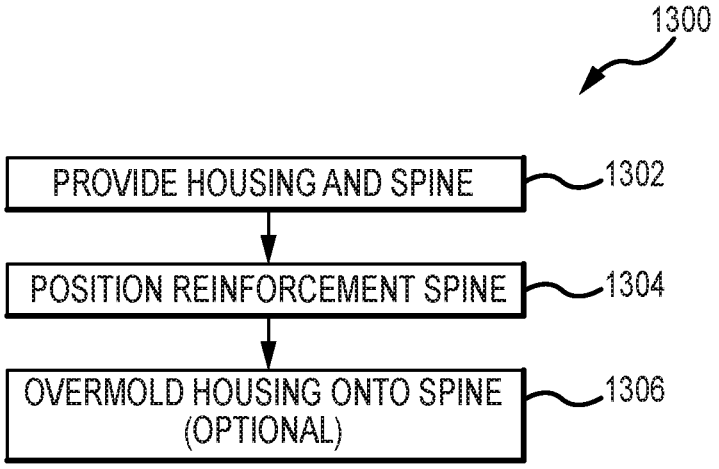
FIG. 13 is a flowchart of a method.

Turning now to FIG. 13, a method 1300 of improving a drop strength in a carbine stock is now described. The method 1300 includes providing 1302 a housing and a reinforcement member, wherein the reinforcement member has a hardness greater than the hardness of the carbine stock. Providing 1302 may include providing a polymeric housing and a reinforcement member made of a metallic material. The method 1300 further includes positioning 1304 at least a portion of the reinforcement member between a locking pin of the stock and a buttpad of the stock. The method 1300 may include overmolding 1306 a polymeric housing onto the reinforcement member. The method 1300 may be achieved using the reinforcing member 108, 208, 308 and/or housing 102, 202, 302 previously described herein.

Figure 14:
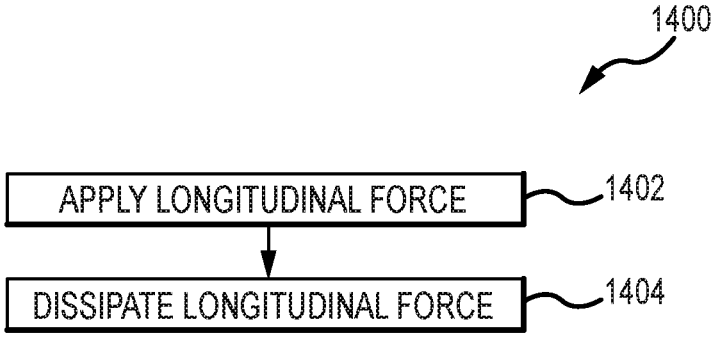
FIG. 14 is a flowchart of a method.

With reference now to FIG. 14, a method 1400 of using a carbine stock is now described. The method 1400 may include applying 1402 a longitudinal or longitudinal drop force on a housing of the stock. The method 1400 may further include dissipating 1404 the longitudinal force from a locking pin in the stock into the housing. Dissipating 1404 may include transferring the longitudinal force into a transverse force. Dissipating 1404 may include providing a force dissipating surface area between a reinforcement member and the housing that is greater than a surface area of contact with the pin.

With reference to FIGS. 15-21, those skilled in the art will recognize that the reinforcing member 108 may have other features. For example, the member 108 may have more or fewer tabs 138 with surfaces 139 similar to the tabs 138 and surfaces 139 previously described herein. These tabs 138 may be referenced herein as side tabs 138. In some embodiments, the tabs 138 need not extend all the way to a bottom of the member 108, thereby maximizing the strength of the member 108.

Figure 15:
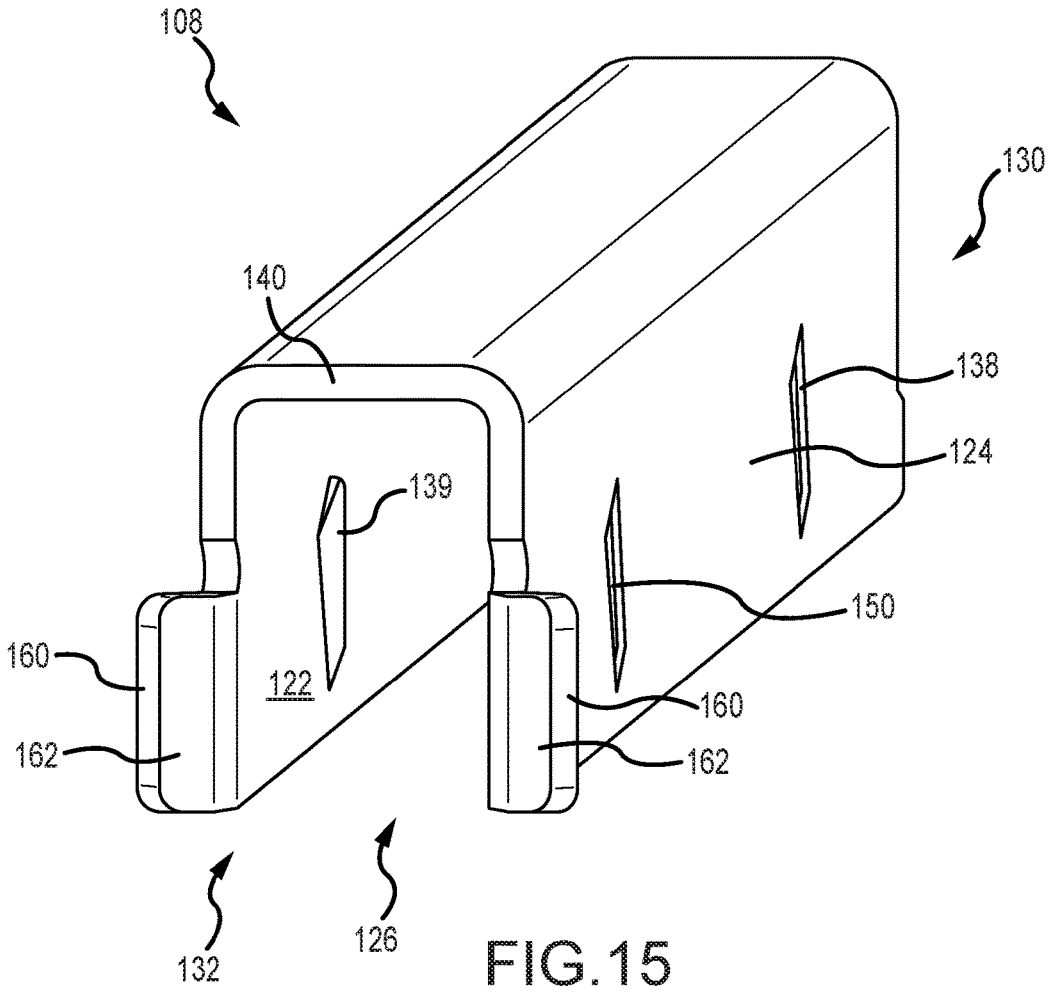
FIG. 15 is a perspective view of a reinforcing member suitable for use in the carbine in FIG. 1.

As seen most clearly in FIG. 15, in some embodiments, a distal end 132 of the member 108 may include one or more tabs 160 extending from the sides 122, 124. The tab(s) 160 may extend at an angle that is transverse or oblique to the side(s) 122, 124. The tab(s) 160 may be configured to engage a flange(s) 172 or rail in a battery tube 174, as illustrated most clearly in FIG. 21. Those skilled in the art will recognize that the tab(s) 160 may be configured to engage a flange(s) in the housing 102.

Figure 16:
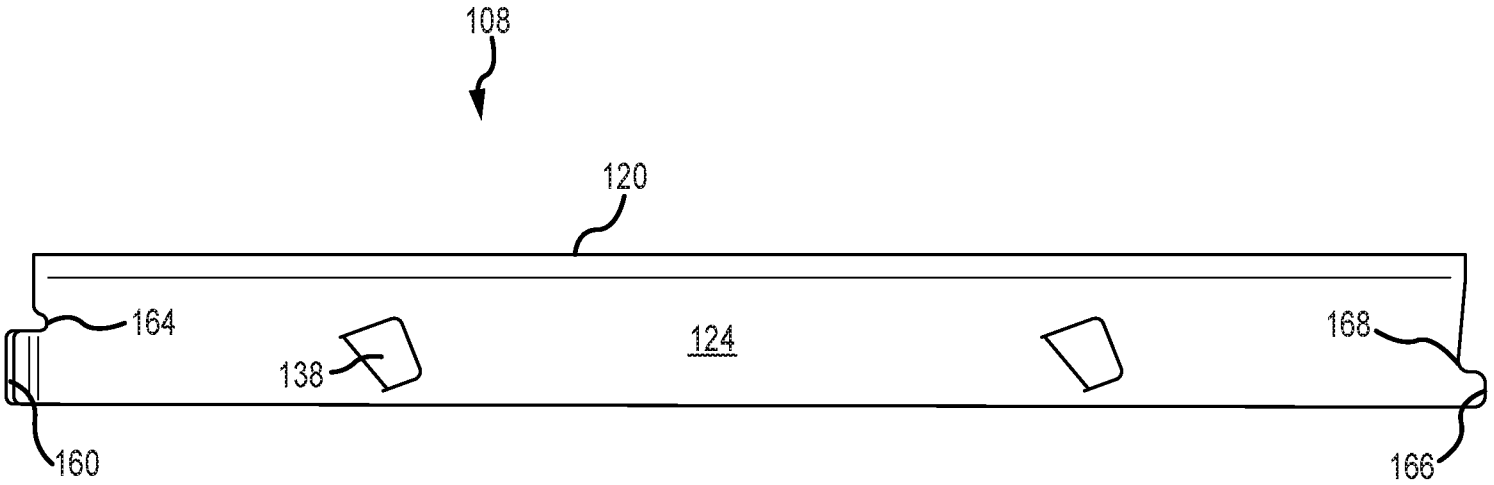
FIG. 16 is a side view of the member in FIG. 15.
Figure 17:
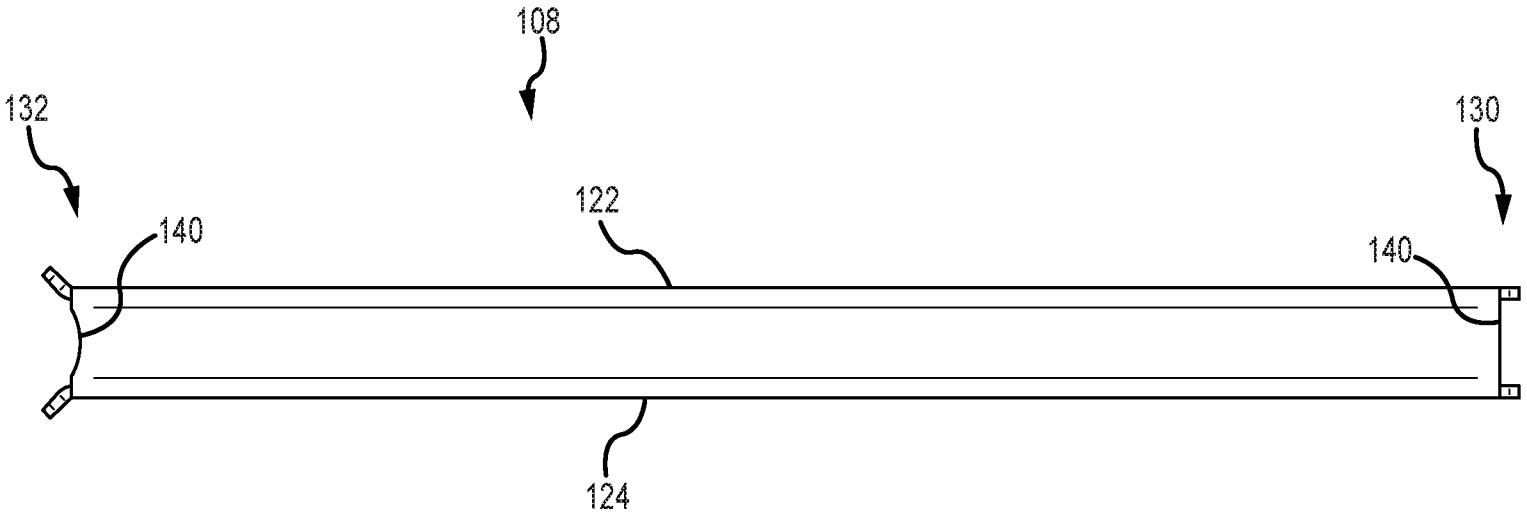
FIG. 17 is a top view of the member in FIG. 15.
Figure 18:
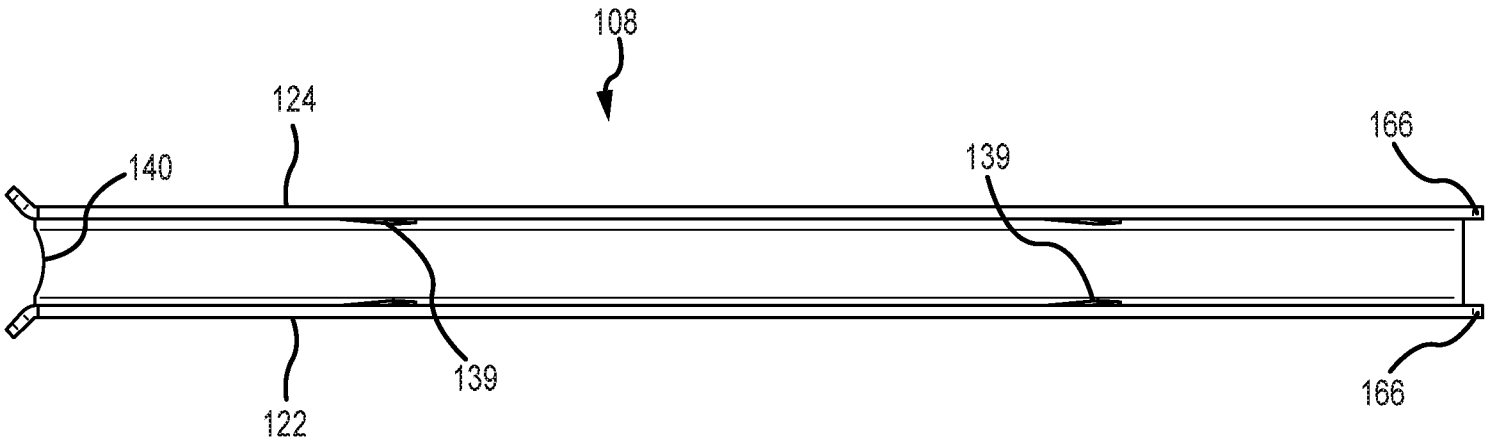
FIG. 18 is a bottom view of the member in FIG. 15.
Figure 19:
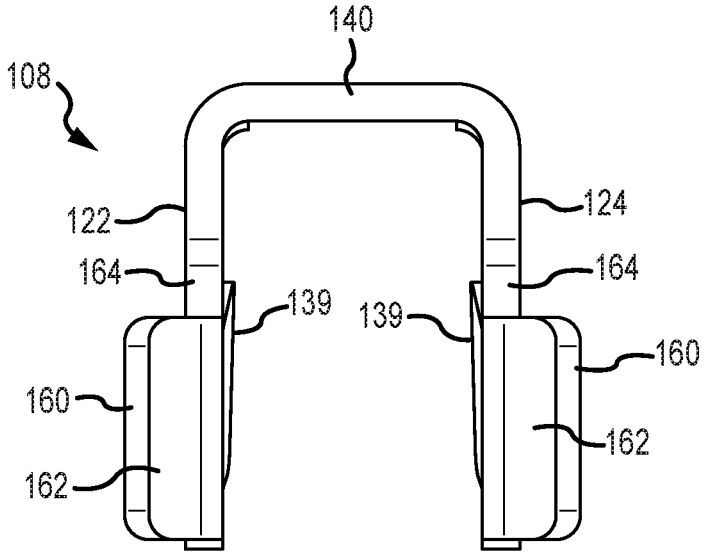
FIG. 19 is an end view of the member in FIG. 15.
Figure 20:
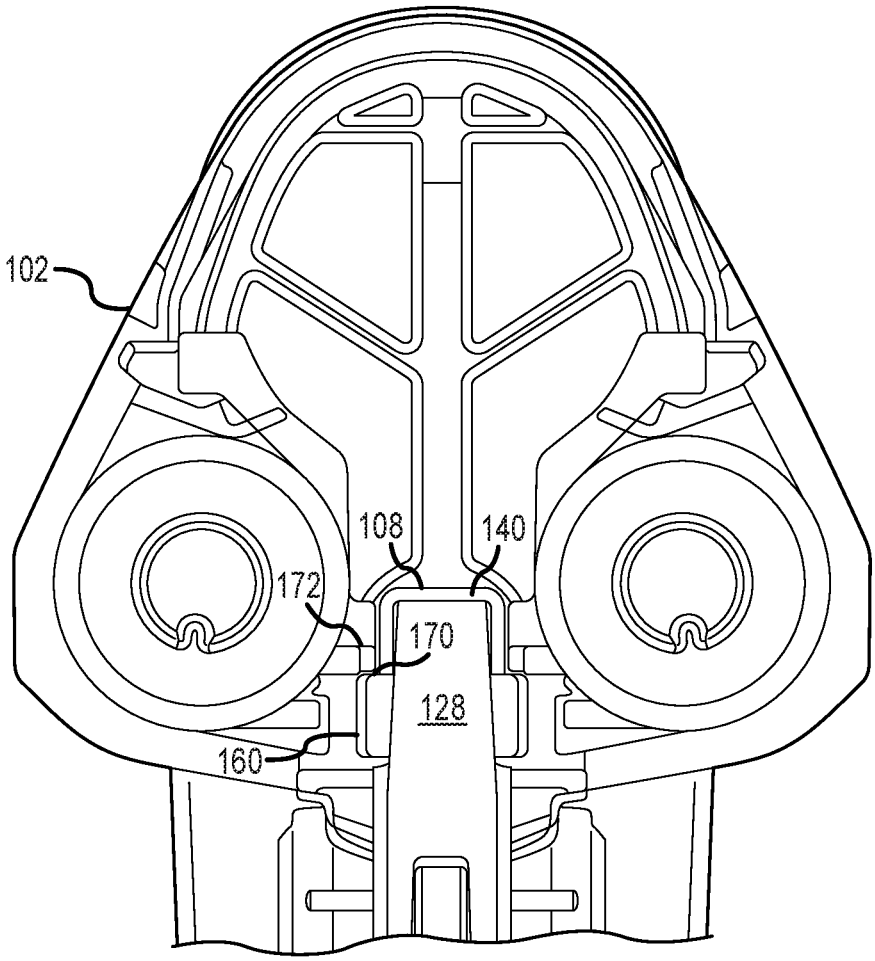
FIG. 20 is a section view illustrating the member in FIG. 15 in a stock.

As illustrated in FIG. 16, a relief 164 may be provided so as to improve a bending of the tab 160 and/or reduce or eliminate stress after the member 108 is formed.

Figure 21:
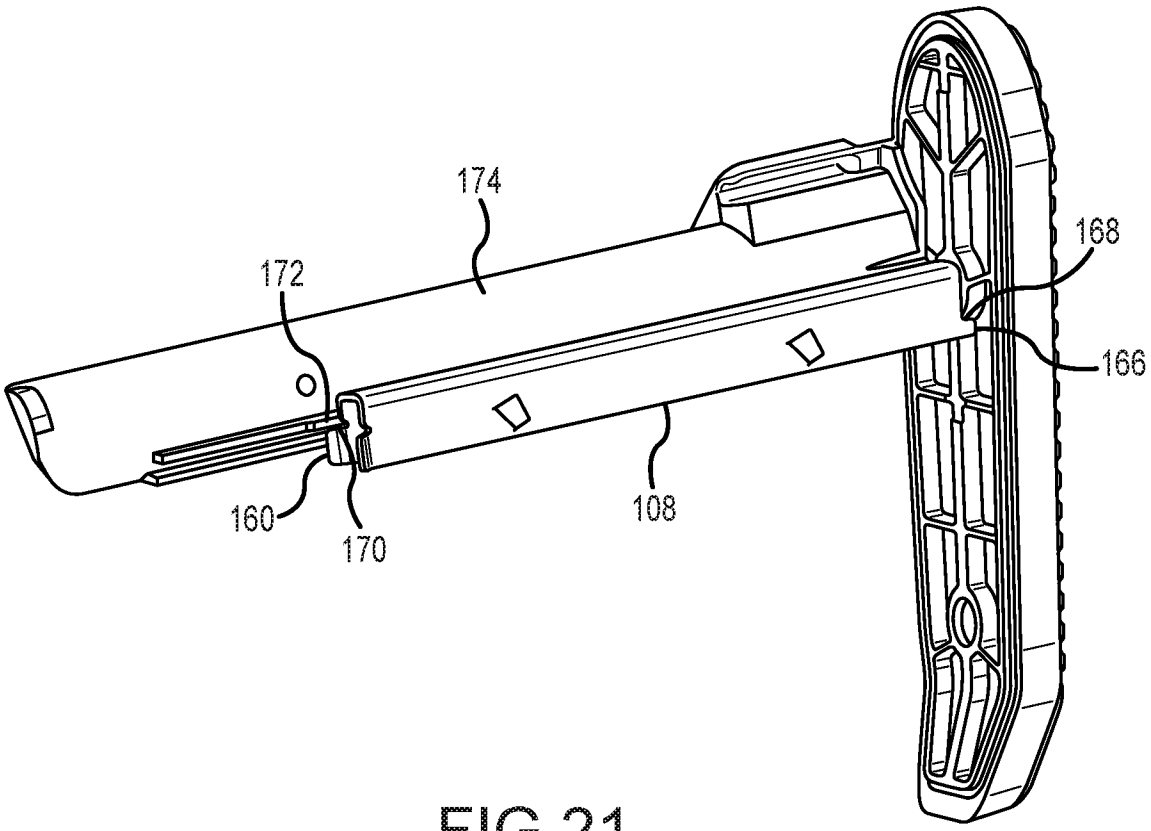
FIG. 21 is a perspective view illustrating relationships between the member in FIG. 15 and other features of the stock in FIG. 20.

Similarly, and as most clearly illustrated in FIG. 21, a proximal end 130 of the member 108 may include one or more tabs 166 extending proximally and/or configured to engage a butt pad and/or other proximal component of the stock. The butt pad may be considered a proximal wall of the housing 102. For example, the tab(s) 166, which may be referenced herein as proximal tab(s) 166 may include a surface 168 shaped to abut a surface of a butt pad or proximal stock component.

The reinforcing member 108 may include at least one distal tab 160, at least one proximal tab 166, and at least one side tab 138, configured to engage two or more of a stock housing 102, a battery tube 174, or a butt pad. The side tab(s) 138 may be configured to engage a ridge in a housing 102. The distal tab(s) may be configured to engage a battery tube 174 or housing 102. The proximal tab(s) may be configured to engage a butt pad.

The distal and/or proximal tabs 160, 166 and the first wall 120 may be configured to constrain vertical movement of the reinforcing member 108, such as by providing flange surfaces 168, 170 that engage flange surfaces in other components of the stock and a ridge 128 of the stock. The side tab(s) 138 may be configured to constrain longitudinal movement of the reinforcing member 108, such as by engaging the ridge 128 of the housing 102.

Figure 22:
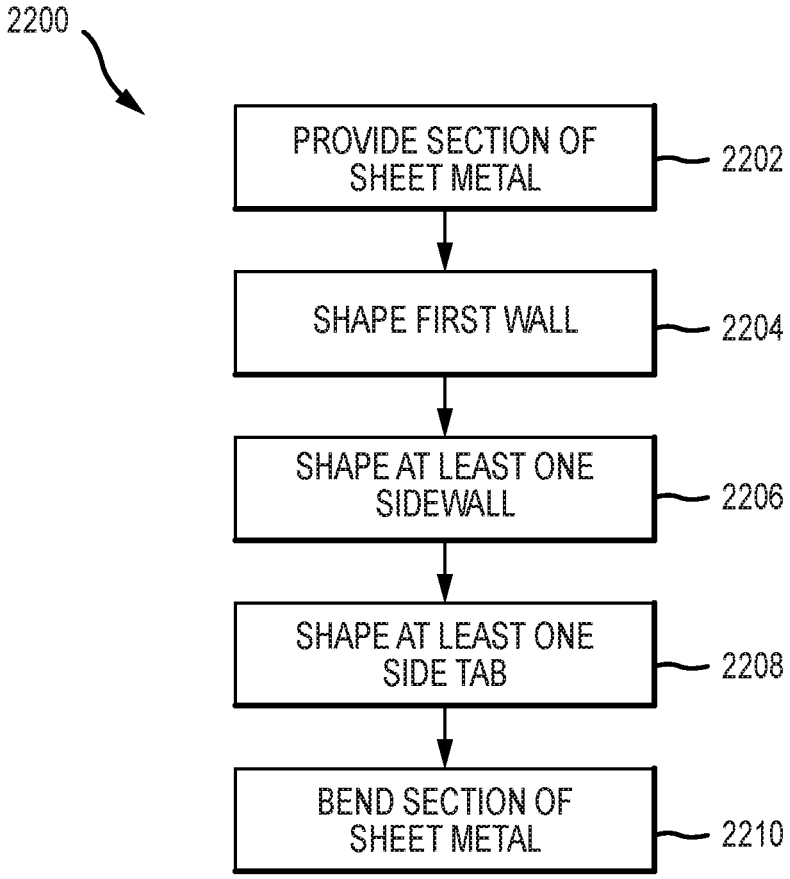
FIG. 22 is a flowchart of a method of making a reinforcing member for the firearm stock.

With reference now to FIG. 22, a method 2200 of making a reinforcing member for a firearm stock is described. The method 2200 may include providing 2202 a section of sheet metal, and shaping 2204 a first wall from the sheet metal, the first wall having a longitudinal length greater than a width, and a distal end having a locking pin engagement surface. The method 2200 may also include shaping 2206 at least one sidewall from the sheet metal, and shaping 2208 at least one side tab on the sidewall. Shaping 2204 the first wall and shaping 2206 the at least one sidewall may include bending 2210 the section of sheet metal to form the first wall and the at least one sidewall whereby the first wall and the at least one sidewall are unitary.

The method 2200 may include shaping at least one distal tab extending from the at least one sidewall, the at least one distal tab extending away from a central portion of the reinforcing member.

The method 2200 may include shaping at least one proximal tab extending proximally from at least one of the first wall or the at least one sidewall.

The method 2200 may include shaping a housing or battery tube flange engagement surface, a butt pad engagement surface, and a housing ridge engagement surface in the reinforcing member.

The method 2200 may include providing a relief for improving bending characteristics of one or more tabs such as the distal tab(s).

The terms and expressions employed herein are used as terms and expressions of description and not of limitation, and there is no intention, in the use of such terms and expressions, of excluding any equivalents of the features shown and described or portions thereof. In addition, having described certain embodiments, it will be apparent to those of ordinary skill in the art that other embodiments incorporating the concepts disclosed herein may be used without departing from the spirit and scope of the disclosure. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of an actuator should be understood to encompass disclosure of the act of actuating—whether explicitly discussed or not—and, conversely, were there only disclosure of the act of actuating, such a disclosure should be understood to encompass disclosure of an actuating mechanism. Such changes and alternative terms are to be understood to be explicitly included in the description.

The previous description of the disclosed embodiments and examples is provided to enable any person skilled in the art to make or use the present disclosure as defined by the claims. Thus, the present disclosure is not intended to be limited to the examples disclosed herein. Various modifications to these embodiments will be readily apparent to those skilled in the art, and the generic principles defined herein may be applied to other embodiments without departing from the spirit or scope of the disclosure as claimed.

What is claimed is:

1. A reinforcing member for a firearm stock, the reinforcing member comprising:

a proximal end having at least one proximal tab;

a distal end having a locking pin engagement surface configured to contact a locking pin of the firearm stock and at least one distal tab extending distally from the distal end;

a longitudinal axis extending between the proximal end and the distal end;

a first wall having a longitudinal length greater than a width;

at least one sidewall one of coupled to or unitary with the first wall; and at least one side tab extending inwardly and at an angle from the at least one sidewall, and engages with and does not move relative to a ridge of the firearm stock, wherein the at least one side tab does not contact the locking pin, wherein the at least one distal tab extends at an angle from the at least one sidewall.

2. The reinforcing member of claim 1, wherein the locking pin engagement surface is curved.

3. The reinforcing member of claim 2, wherein the locking pin engagement surface is shaped to encircle the locking pin and allow the locking pin to pass through and engage two or more holes in a firearm receiver extension at different times.

4. The reinforcing member of claim 1, wherein:

the at least one proximal tab extends proximally from at least one of the first wall or the at least one sidewall; and the at least one proximal tab is shaped and positioned to engage with and below a portion of a proximal wall or butt pad of the firearm stock.

5. The reinforcing member of claim 1, wherein:

the locking pin engagement surface is configured to align with two or more holes in a firearm receiver extension at different times.

6. The reinforcing member of claim 1, wherein the at least one side tab is configured to form an interference fit with the ridge of the firearm stock.

7. The reinforcing member of claim 1, wherein the at least one side tab is cut out of the at least one sidewall leaving an associated opening in the sidewall.

8. The reinforcing member of claim 1, wherein the at least one side tab has a same thickness as the at least one sidewall.

9. The reinforcing member of claim 1, wherein the at least one side tab extends at an upward angle toward the first wall.

* * * * *